US007000340B1

(12) United States Patent
Uchikoshi

(10) Patent No.: US 7,000,340 B1
(45) Date of Patent: Feb. 21, 2006

(54) SHIRTS PRESS WITH FUNCTION FOR EXTENDING COLLAR

(75) Inventor: Mitsuyuki Uchikoshi, Tokyo (JP)

(73) Assignee: San Kousha Co., Ltd., Tokyo (JP)

( * ) Notice: Subject to any disclaimer, the term of this patent is extended or adjusted under 35 U.S.C. 154(b) by 0 days.

(21) Appl. No.: 10/930,595

(22) Filed: Aug. 31, 2004

(51) Int. Cl.
*D06F 71/22* (2006.01)

(52) U.S. Cl. ..... 38/16; 38/19

(58) Field of Classification Search ..... 38/12, 38/17, 19, 20, 24, 64; 223/52.1, 52.5, 57, 223/70
See application file for complete search history.

(56) References Cited

U.S. PATENT DOCUMENTS 1,938,883 A * 12/1933 Winnewisser ..... 223/52.1
2,046,785 A * 7/1936 Malott, Jr. ..... 38/20
2,319,211 A * 5/1943 Cluett et al. ..... 223/57
2,859,545 A * 11/1958 Williams ..... 38/20
3,136,079 A * 6/1964 Neckel ..... 38/21
3,430,368 A * 3/1969 Lancaster, Jr. ..... 38/21
6,722,063 B1 4/2004 Uchikoshi

* cited by examiner

*Primary Examiner*—Ismael Izaguirre
(74) *Attorney, Agent, or Firm*—Andrus, Sceales, Starke & Sawall, LLP

(57) ABSTRACT

The shirt press of the present invention is formed to comprise a collar iron buck on which a collar is mounted while being expanded and a press iron for depressing against the buck. The upper surface of the buck corresponds to a central part of the collar and is notched in an inverse triangle shape. The right and left positions correspond to the collar ends and are placeable on left and right buck portions into a horizontal surface. The collar is mounted on the buck and a receiving plate, which is arranged above the upper-notched surface with the height thereof being set to the left and right buck portions, supports a central portion. When the press iron is lowered the ends of the collar are pressed and pulled out such that the iron surface of the press is formed into a flat surface.

6 Claims, 9 Drawing Sheets

SHIRTS PRESS WITH FUNCTION FOR EXTENDING COLLAR

BACKGROUND OF THE INVENTION

1. Field of the Invention

This invention relates to a shirts press for use in finishing in press for a shirts such as a washed shirts and the like. More particularly, this invention relates to a shirts press with a function for extending a collar formed in such a way that the shrunk collar due to its washing can be extended in a neat manner and pressed.

2. Description of the Related Art

As this type of a shirts press, there has been provided a machine devised by the present applicant that is described in a gazette of U.S. Pat. No. 6,722,063, for example. This type of related art shirts press comprises a collar iron buck on which the collar is placed while being expanded and a press iron for depressing against the upper surface of the iron buck for a collar to press it, wherein a radius of curvature at the upper surface of the iron buck for a collar is selected to be larger than that of an iron surface of the press iron. Then, the iron buck for a collar is divided into two right and left segments at its central position and so the iron buck is formed by a pair of the right and left divided segments. In addition, this shirts press is provided with a depressing mechanism for turning each of the divided segments in an upward outside direction when a collar is pressed and for depressing the collar against an iron surface of the press iron.

However, in this type of prior art press used for a press work, the iron buck on which a collar is placed while being expanded was formed in a mountain-shape curved upwardly in a convex form and the iron surface of the press for pressing a collar was formed into a concave curved shape.

Due to this fact, the prior art press produced a difference in extension at a cloth of each of a front side and a rear side of a collar because the collar was finished in press into a curved shape. Accordingly, when a person put on a white shirts pressed by the prior art press, some wrinkles were easily formed at the inner surface of a collar with the result that the wrinkles produced a problem that the wrinkles give an uncomfortable feeling to the wearing person and caused a wearing posture to be bad. In addition, the prior art press had a problem that since a wrinkle could easily be produced at the rear side of a collar, the wrinkle could easily become a hindrance item when a person worn a neck-tie through the collar.

This invention has been invented in reference to such a prior art problem described above.

Accordingly, it is a technical problem to be solved by the present invention to provide a shirts press having a function of extending or expanding a collar in which the collar shrunk by its washing work can be extended or expanded, finished into a new product state in a neat manner and at the same time the collar can be extended and finished in the same sizes of a front side and a rear side of the collar without producing any difference in a circumferential length of its neck part.

SUMMARY OF THE INVENTION

As shown in FIGS. 1, 7 and 9 and the like, the shirts press of the present invention is formed while comprising a collar iron buck on which a collar of a shirts is placed while it is being extended or expanded and a press iron for pressing the collar by depressing against the upper surface of the collar iron buck. A position of the upper surface of the collar iron buck corresponding to the central part of the collar in a longitudinal direction is notched into an inverse triangular shape as seen from its front elevational view. The right and left positions corresponding to both ends of the collar in its longitudinal direction communicating with the upper surface position have a horizontal surface. The upper surface of the collar iron buck is formed into such a shape as one in which it may be fallen into a flat surface when it is depressed by the press iron. In addition, this upper surface is provided with a receiving plate for supporting the central part of the collar in its longitudinal direction when the collar is placed on the collar iron buck. This receiving plate is arranged above the upper surface position where it is notched in an inverse triangular shape with its height being set to the same height as those of the right and left position corresponding to both ends of the collar, and concurrently when the press iron depresses against the collar, the receiving plate is formed such that it can be pulled out of it. Additionally, the iron surface of the aforesaid press iron is formed into a flat surface shape.

A technical meaning of ". . . formed into such a shape as one in which it may be fallen into a flat surface . . . " in the specification is meant by a feature that when a depressing force of the press iron is applied on the upper surface of the collar iron buck, the upper surface is fallen into a flat surface shape and in turn when the depressing force is removed or released, the upper surface is recovered to its original shape. Further, a technical meaning of ". . . when the press iron depresses against the collar, the receiving plate can be pulled out of it . . ." is meant that the receiving plate is not depressed together with the collar. In the present invention, a timing applied for pulling out the receiving plate is normally selected just before the press iron depresses against the collar. However, if the depressing force of the press iron is completely applied to the collar, applying of the depressing force may also be applied just after it.

The present invention is operated such that the collar iron buck is fallen into a flat surface state. And in this case, the iron surface of the press iron is formed in a flat surface. Accordingly, with this arrangement, both the front side and the rear side of the collar are pressed under the same size state.

DESCRIPTION OF THE PREFERRED EMBODIMENTS

Referring now to the accompanying drawings, one preferred embodiment of the present invention will be described as follows.

Figure 1:
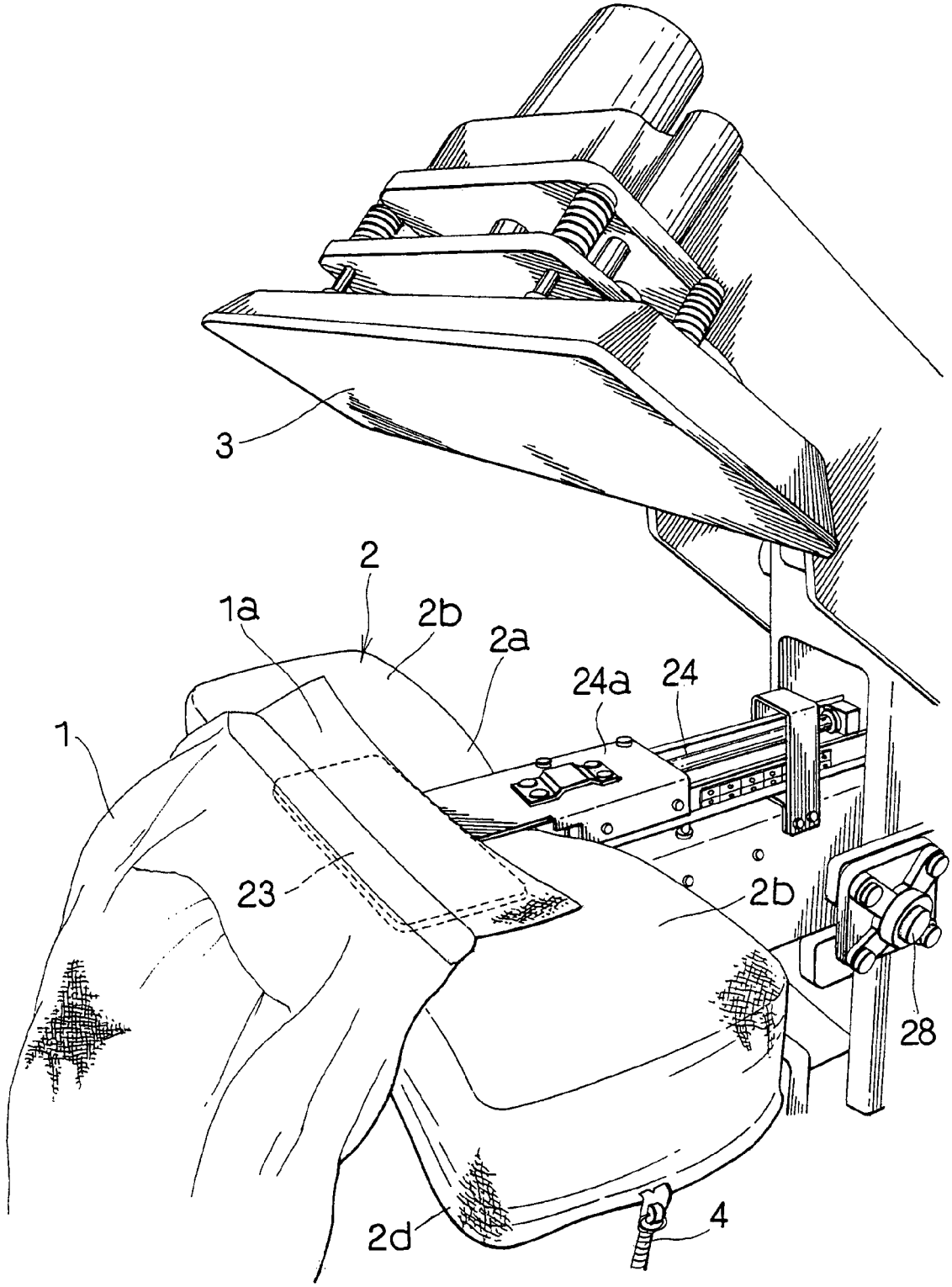
FIG. 1 is a substantial perspective view for showing a time of usage to illustrate one preferred embodiment of the press of the present invention.

As shown in FIG. 1 and the like, a shirts press of the present invention is constructed such that the same comprises a collar iron buck 2 on which a collar 1*a* of a shirts 1 is mounted while being expanded; and a press 3 for depressing against the upper surface of the collar iron buck 2 to press the collar 1*a* into its finished state. An iron surface of the press 3 is formed into a flat surface. In addition, an upper surface position 2*a* of the collar iron buck 2 corresponding to the central part of the collar 1*a* in its longitudinal direction is formed into an inverse triangular shape as seen from its front elevational view. Then, the right and left positions 2*b* corresponding to both ends of the collar 1*a* in its longitudinal direction communicating with the upper surface position 2*a* are formed into a horizontal surface.

Figure 7:
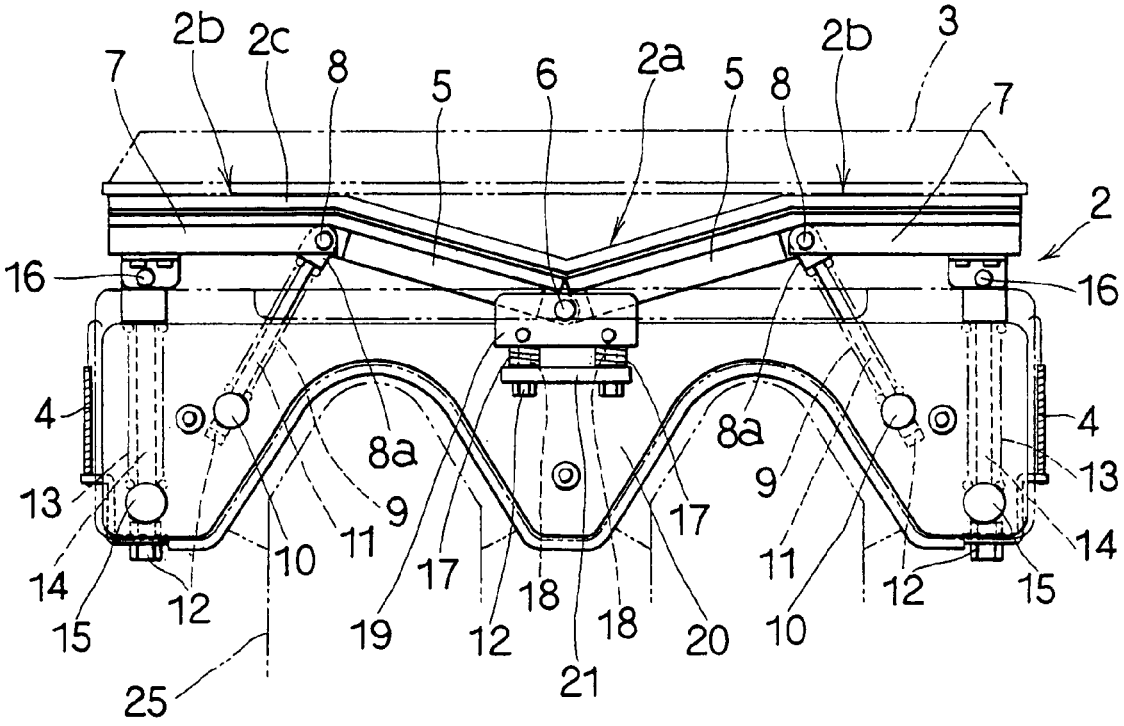
FIG. 7 is a substantial front elevational view for showing a collar iron buck in which a front cover is removed.
Figure 8:
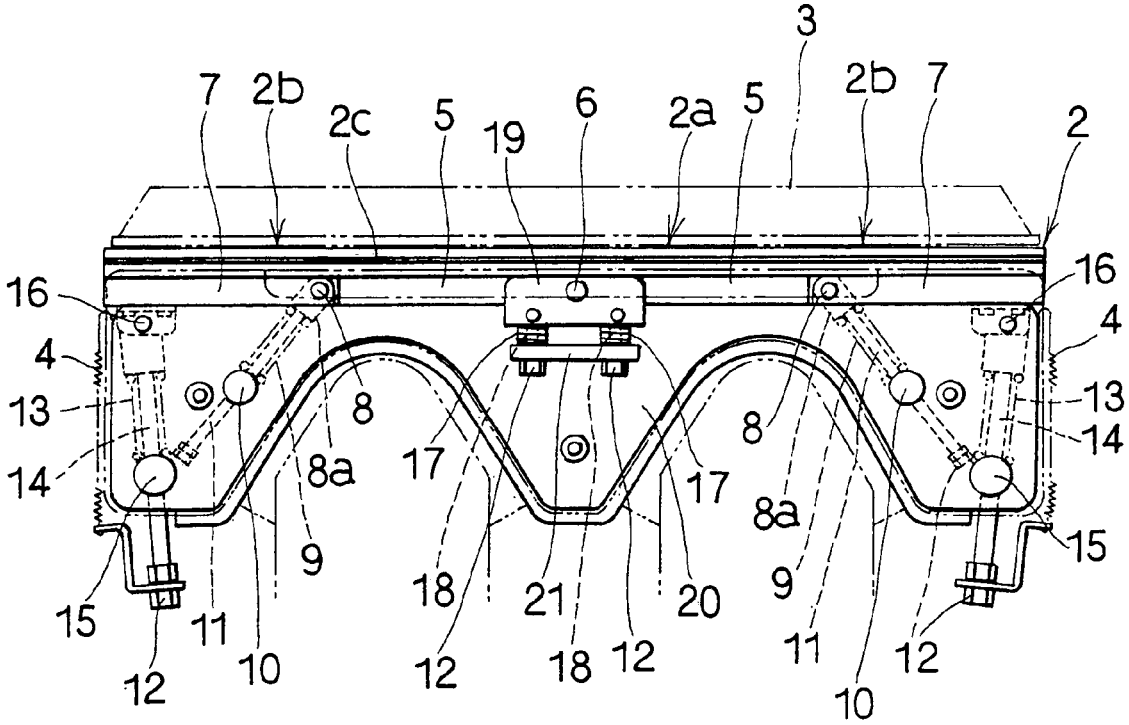
FIG. 8 is a substantial front elevational view for showing a state in which a collar iron buck having a front cover removed from it is fallen.
Figure 9:
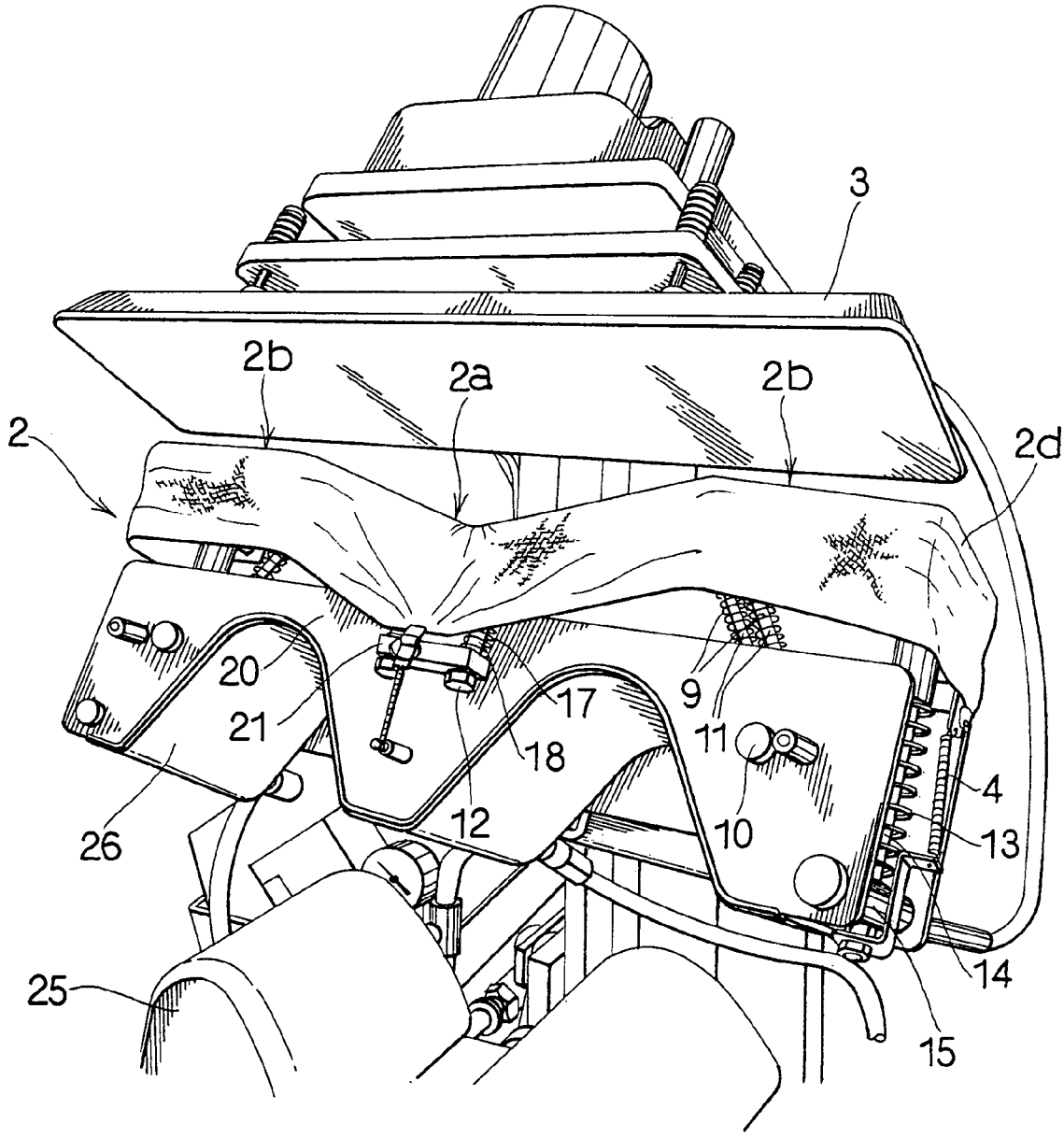
FIG. 9 is a substantial perspective view for showing the press under a state in which a front cover is removed.
Figure 10:
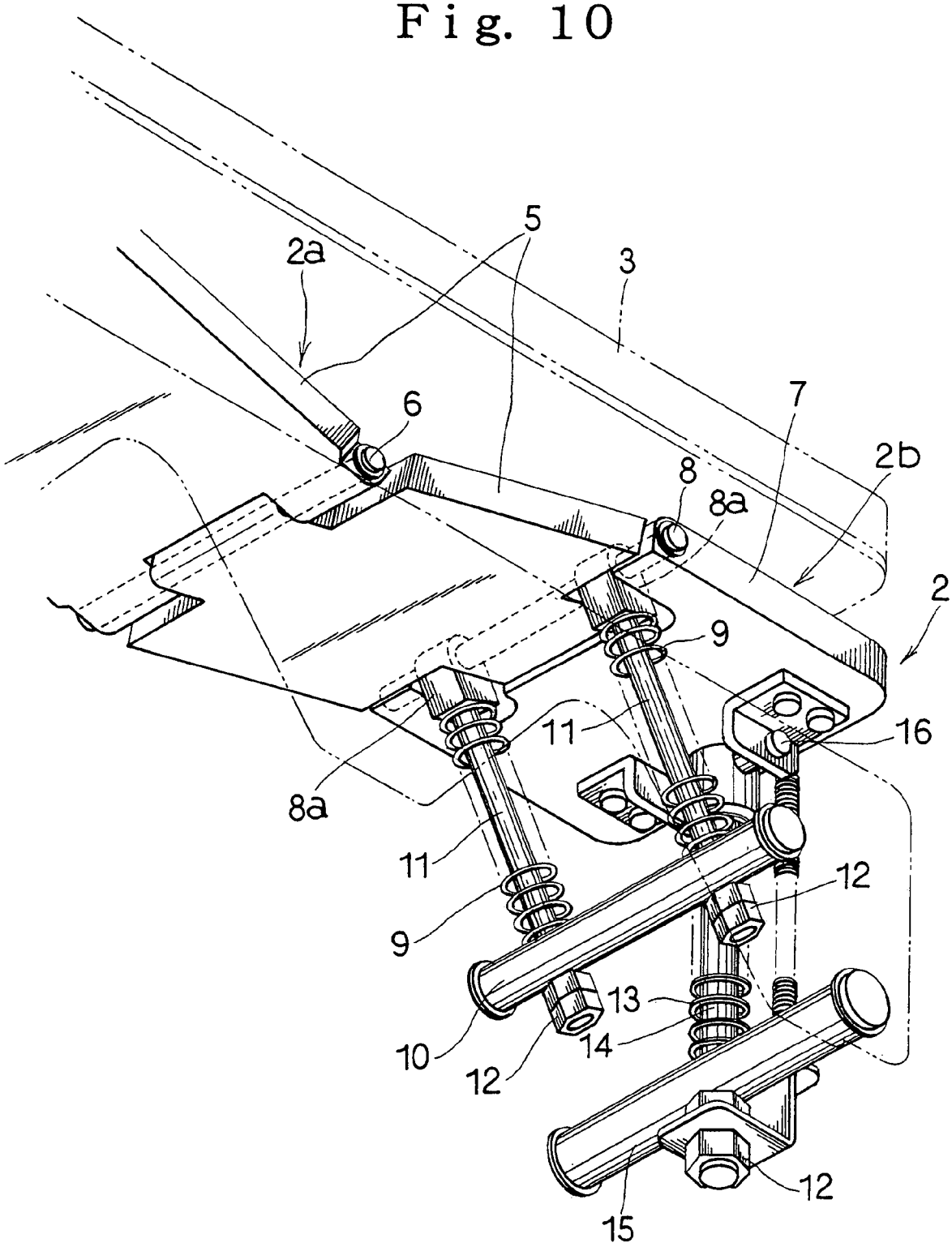
FIG. 10 is a substantial perspective view for showing a collar iron buck.
Figure 11:
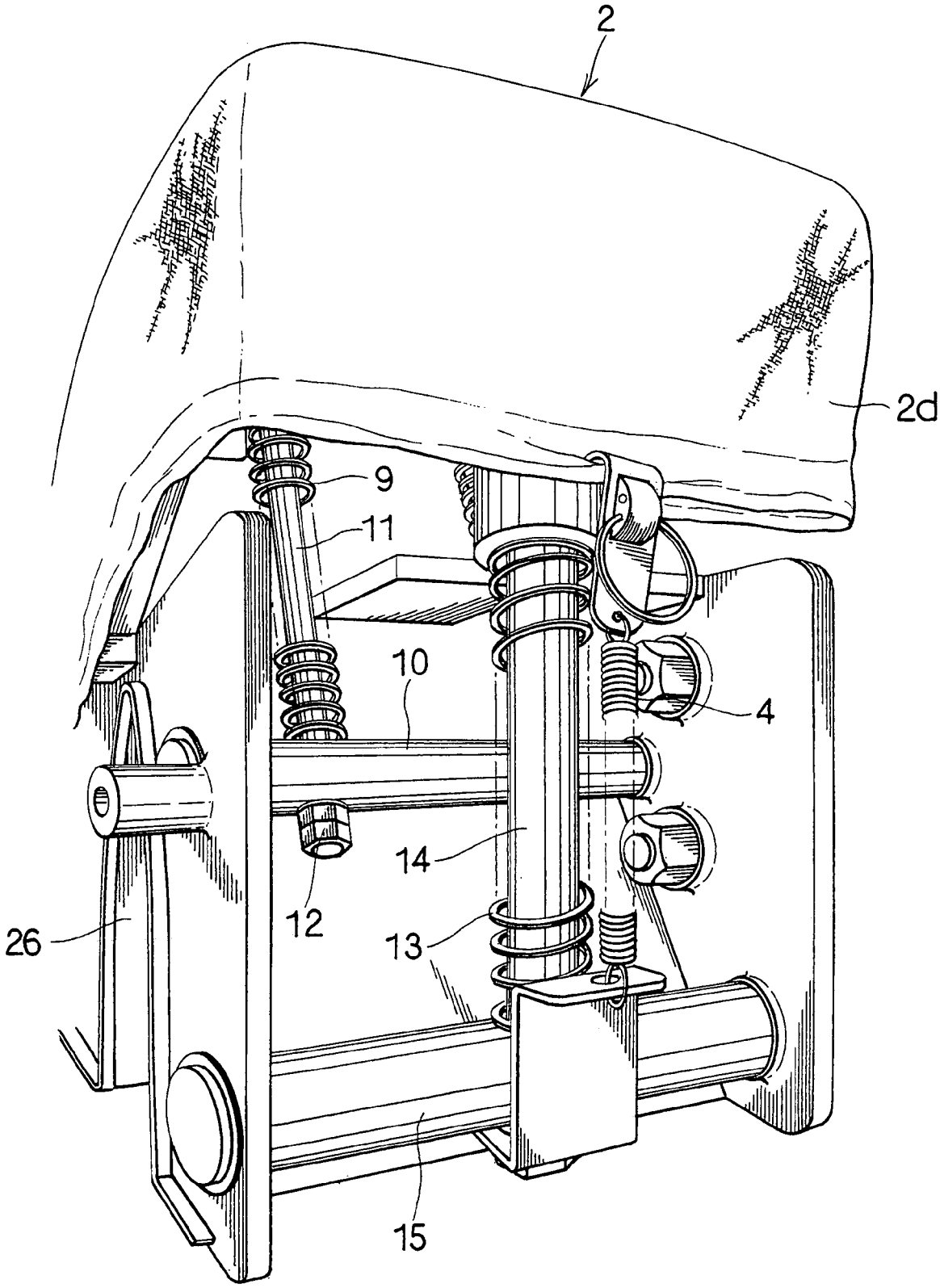
FIG. 11 is a substantial perspective view for showing a collar iron buck.

The upper surface of the collar iron buck 2 has a mat layer 2*c* (refer to FIG. 7) and is covered by a cloth cover 2*d* (refer to FIG. 1 and the like). Reference numeral 4 denotes a coil spring for pulling down the cloth cover 2*d* and applying a tension to it.

In the present invention, the upper surface of the collar iron buck 2 is formed such that it can be fallen into a flat surface when it is depressed by the press iron 3. As shown in FIGS. 6 to 11, the upper surface position 2*a* of the collar iron buck 2 is set such that a pair of right and left plates 5 are rotatably connected by a pivot shaft 6 and formed into an inverse triangular shape as seen from its front elevational view. Additionally, the side ends of a pair of right and left plates 5 are pivoted via the joint shaft 8 to horizontal plates 7 forming the right and left positions 2*b* corresponding to both ends of the collar 1*a* in its longitudinal direction.

Reference numeral 9 denotes a first coil spring supporting the joint shaft 8. This first coil spring 9 is externally arranged to a slant first metallic rod 11 connected to a joint block 8*a* between a joint block 8*a* of the joint shaft 8 and a first supporting rod 10 laterally installed along a forward or rearward direction of the collar iron buck 2. The lower part of the first metallic rod 11 is inserted into and passed through the first supporting rod 10 in such a way that it can be moved up or down, and set by a nut 12 against its pulling-out state. In addition, a tail end of the horizontal plate 7 is supported by a second coil spring 13. This second coil spring 13 is externally installed at a raised second metallic rod 14 in the same manner as that for the first coil spring 9, the lower part of the second metallic rod 14 is inserted into and passed through the second supporting rod 15 in such a way that it can be moved up or down and then set by a nut 12 against its pulling-out state. In addition, the upper end of the second metallic rod 14 is pivoted at the horizontal plate 7 in such a way that it may be inclined in a rightward or rearward direction through the lateral shaft 16 (refer to FIGS. 7, 8 and 10).

The upper surface position 2*a* of the collar iron buck 2 is supported by springs 17 arranged below the pivot shaft 6, and when the upper surface position becomes a flat surface attitude while being depressed by the press iron 3, it can be descended as it is. Each of a pair of the right and left springs 17 in this preferred embodiment is arranged at a front side and a rear side of the collar iron buck 2, respectively. In addition, the springs 17 are externally arranged at vertical third metallic rods 18 (refer to FIGS. 7 and 9) and installed between the upper members 19 having an end part of the pivot shaft 6 connected thereto and a protrusion piece 21 fixed to the front or rear vertical wall 20 of the collar iron buck 2, the lower part of the third metallic rod 18 is inserted into and passed through the protrusion piece 21 in such a way that it can be moved up or down and further set by a nut 12 against a pulling-out state. For a sake of convenience in description of the springs 17 and the like, a front cover 22 (refer to FIGS. 2 and 3) is removed from the collar iron buck 2 shown in FIG. 7 and the like.

Figure 4:
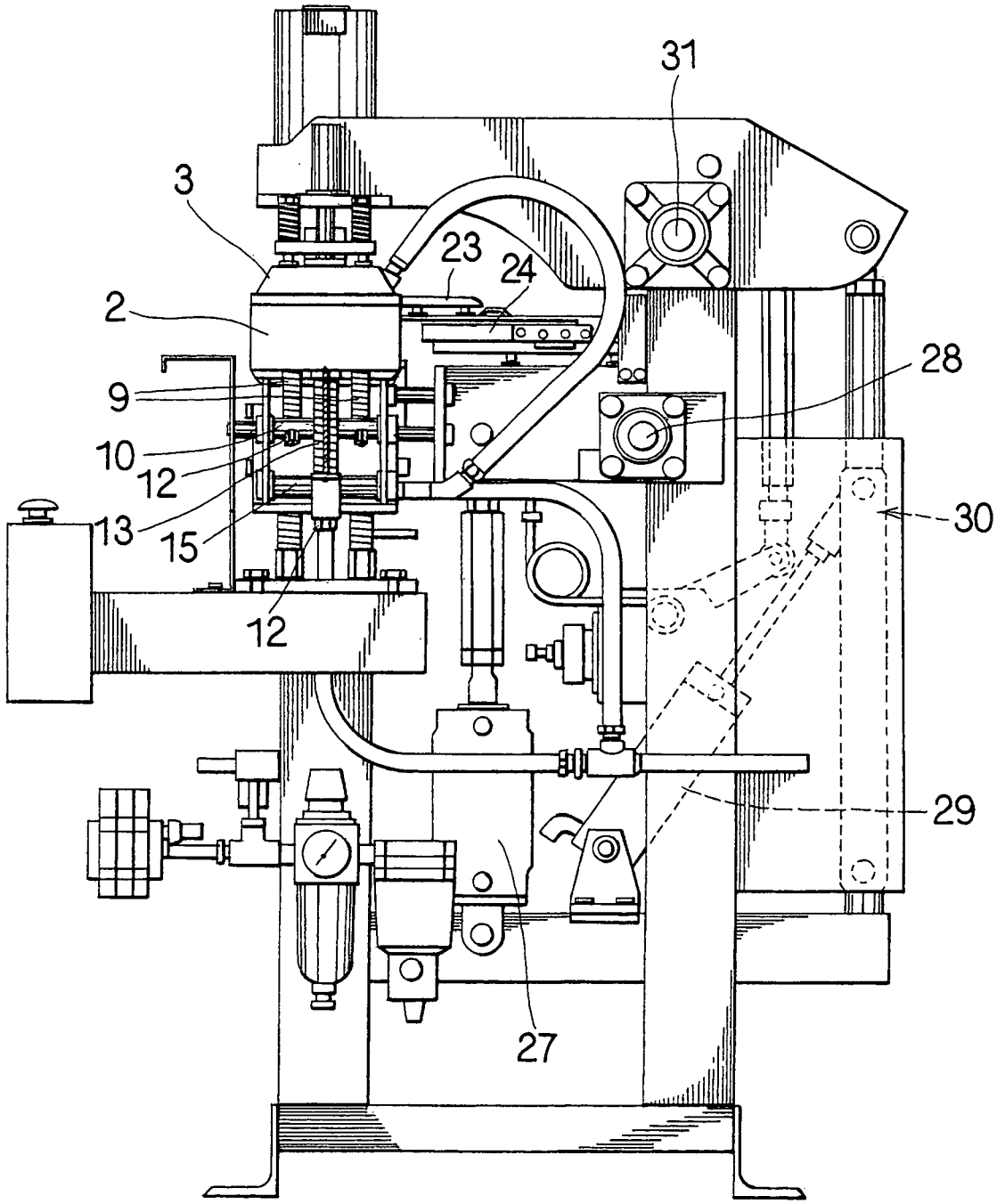
FIG. 4 is a right side elevational view for showing the press of the present invention.
Figure 5:
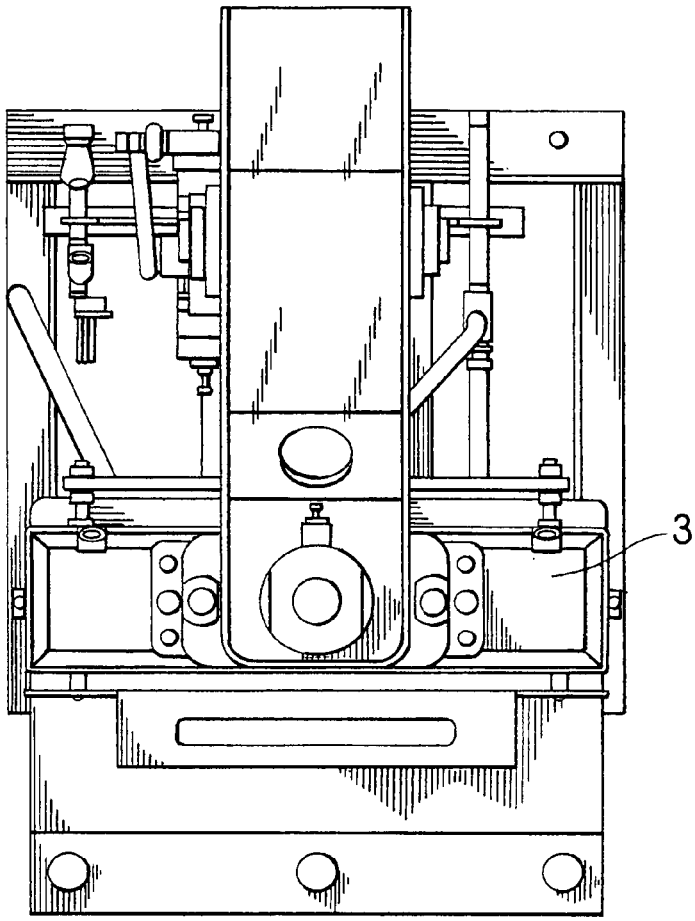
FIG. 5 is a top plan view for showing the press of the present invention.
Figure 6:
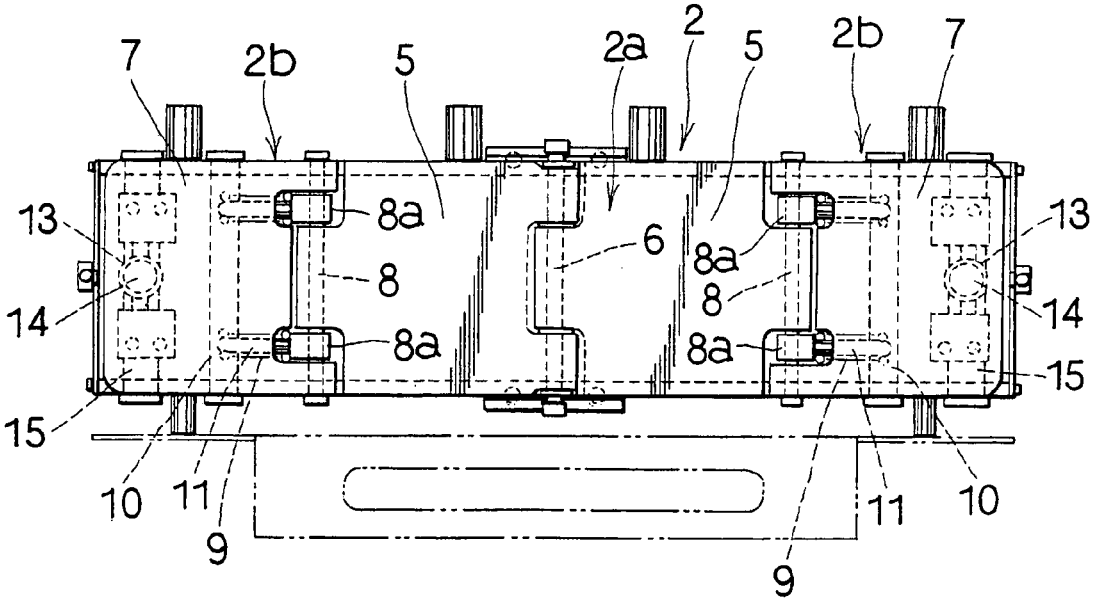
FIG. 6 is a substantial top plan view for showing a collar iron buck in which a cover is removed.

Additionally, as shown in FIGS. 1 and 4, the present invention is made such that when the collar 1*a* is mounted on the collar iron buck 2, it is provided with a receiving plate 23 for use in supporting the central part of the collar 1*a* in its longitudinal direction. This receiving plate 23 is arranged above the upper surface position 2*a* notched in an inverse triangular shape under the same height as the right and left positions 2*b* corresponding to both ends of the collar 1*a* when the collar 1*a* is supported and at the same time when the press iron 3 depresses against the collar 1*a*, the receiving plate can be pulled out.

Reference numeral 24 denotes a cylinder for use in moving the receiving plate 23 in a forward or rearward direction. This cylinder 24 is constituted by a rod-less cylinder, for example, and arranged at a rear side of the collar iron buck 2 in a horizontal state. The receiving plate 23 is fixed to an operating part 24*a* slid in a forward or rearward direction of the rod-less cylinder.

Figure 2:
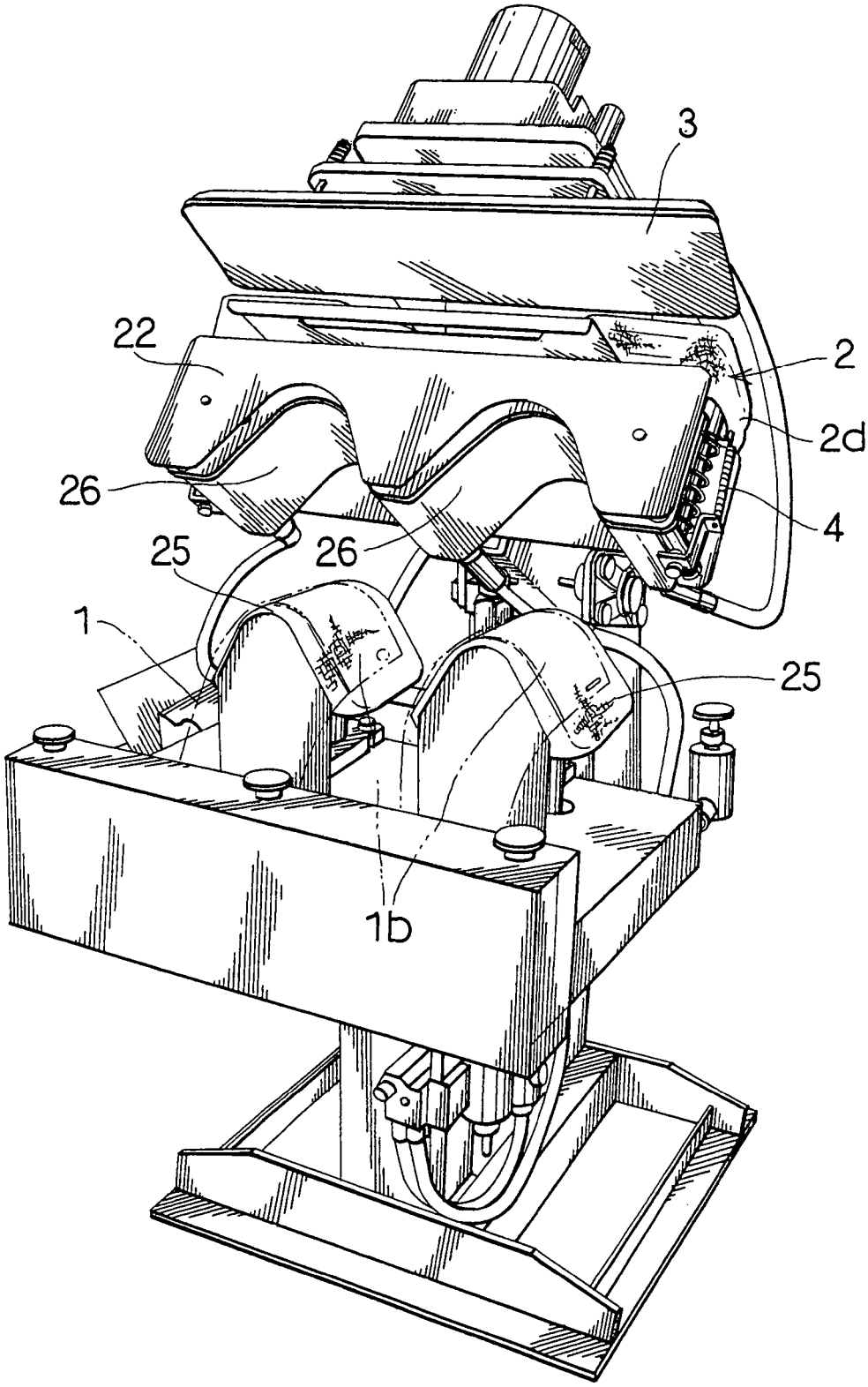
FIG. 2 is a perspective view for showing an operating time of the press of the present invention.
Figure 3:
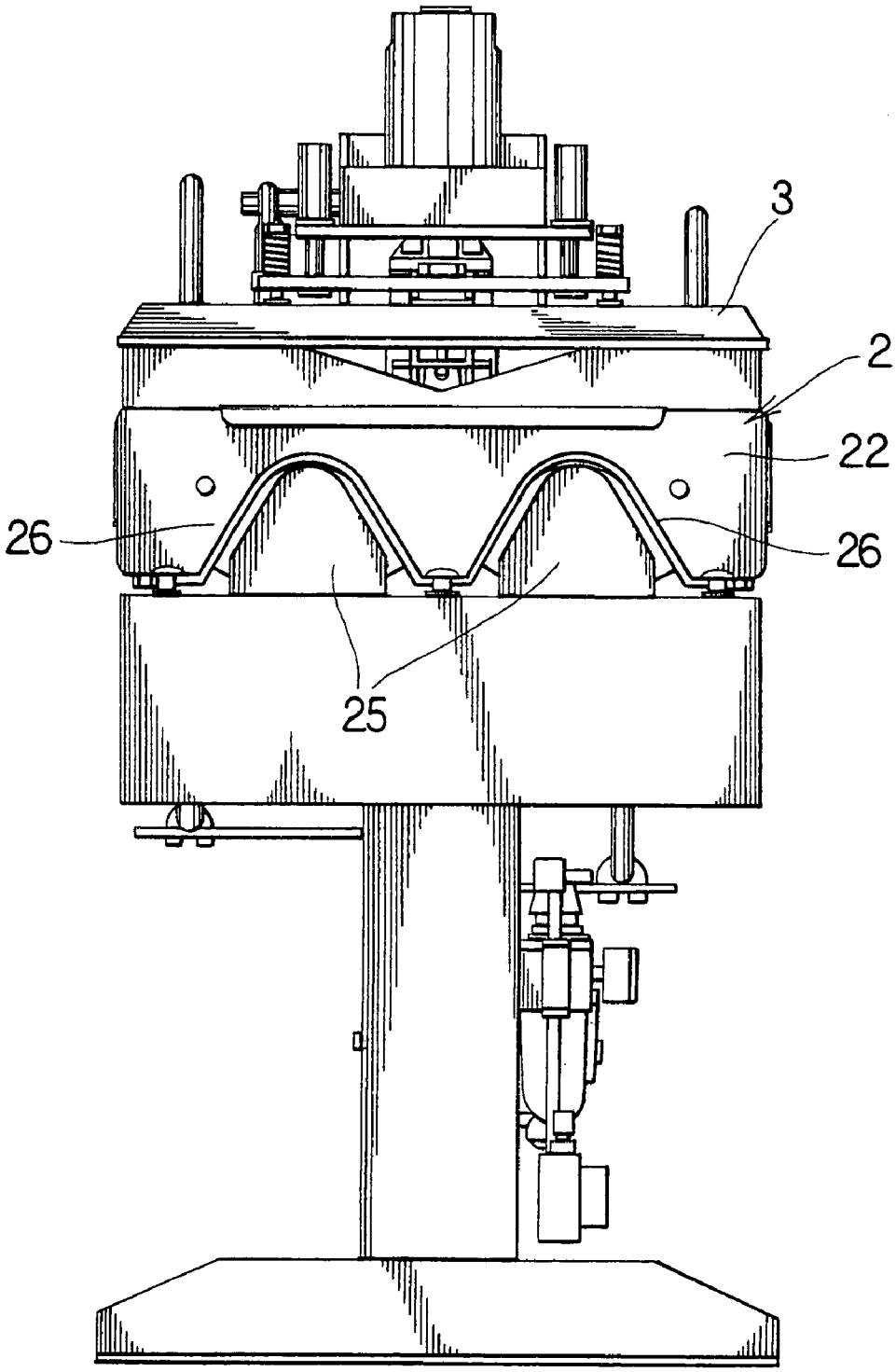
FIG. 3 is a front elevational view for showing the press of the present invention.

Reference numeral 25 (refer to FIGS. 2 and 3 and the like) denotes a mountain-shaped iron buck for cuff for use in setting a cuff 1*b* of the shirts 1. A pair of right and left iron bucks 25 for cuffs are arranged below the collar iron buck 2.

In addition, reference numeral 26 (refer to FIGS. 2 and 3) denotes an iron for use in depressing the upper surface of the cuff iron buck 25. The iron 26 is formed at the lower surface of the collar iron buck 2 in such a way that it is notched upwardly in a mountain-shape. The collar iron buck 2 is formed such that it can be turned up or down around a fulcrum point 28 through extending or retracting operation of the rod in a cylinder device 27 (refer to FIG. 4) arranged in a raised manner.

In FIG. 4, reference numeral 29 denotes an operating cylinder for the press 3. The press iron 3 is turned in an upward or downward direction around the pivot part 31 via the link mechanism 30 so as to depress against the collar iron buck 2 and at the same time to depress the iron buck 25 for cuff below it through the collar iron buck 2.

Next, an action of the present invention in accordance with the preferred embodiment will be described as follows.

As shown in FIG. 2, at first, an operator sets the cuff 1*b* of the shirts 1 to the cuff iron buck 25. Then, when the operator depresses a start button, a rod in the cylinder device 27 (refer to FIG. 4) retracts. With the foregoing operation, the collar iron buck 2 descends and turns, and the iron part 26 depresses against the cuff iron buck 25 (refer to FIGS. 3 and 4).

In addition, in concurrent with a driving operation of the cylinder device 27, the rod-less cylinder 24 (refer to FIGS. 1 and 4) is driven to cause the receiving plate 23 to move forward and then the receiving plate 23 is arranged above the upper surface position 2*a* notched in an inverse triangular shape. Under this state, the operator sets the collar 1*a* of the shirts 1, as shown in FIG. 1, at the upper surface of the collar iron buck 2 while being expanded. Then, when the operator depresses the switch, the rod in the operating cylinder 29 (refer to FIG. 4) extends and the press iron 3 turns downward around the pivot part 31. Then, when a sensor (not shown) detects that the rod in the operating cylinder 29 extends, the rod-less cylinder 24 is operated while receiving a signal from the sensor, the receiving plate 23 slides in a rearward direction and retracts. With the foregoing operation, the receiving plate 23 is pulled out of the upper surface position 2*a* of the collar iron buck 2.

Thus, when the press iron 3 depresses against the collar 1*a*, the plate 5 forming the upper surface position 2*a* (refer to FIGS. 6 and 7) is turned downward around the pivot shaft 6 and depressed. In addition, the horizontal plates 7 at the right and left positions 2*b* corresponding to both ends of the collar 1*a* are gradually depressed down against a resilient force of the first coil spring 9 and the second coil spring 13 while slightly moving in an outward direction. Then, the plates 5 and the horizontal plates 7 are finally fallen into a flat surface state and further depressed down by the press iron 3 up to a limit where the spring 17 can be compressed while being kept fallen. With such an arrangement as above, the wrinkle at the collar 1*a* is further extended while the spring 17 is in the maximum compression stroke.

In addition, in the present invention, when the press iron 3 depresses against the collar iron buck 2, its press pressure is also applied to the cuff iron buck 25. Accordingly, the iron part 26 depresses against the cuff 1*b* and the cuff 1*b* is pressed in its finish in concurrent with the collar 1*a*.

The present invention is operated such that the collar iron buck 2 is fallen flat through a depressing operation of the press iron 3, and the collar 1*a* is depressed with the press iron 3 having the iron surface formed into a flat surface. Accordingly, in accordance with this arrangement, it is possible to extend both the front side and the rear side of the collar 1*a* in the right or left direction in the same size and to press them in a neat manner.

In the foregoing arrangement, it is also applicable in the present invention that there is provided only the collar iron buck 2 and the cuff iron buck 25 is eliminated. However, when the press is formed while being provided with the cuff iron buck 25, not only the collar 1*a* but also the cuff 1*b* can be pressed concurrently through one pressing operation as described in the foregoing example and so the present invention provides an advantage that its working efficiency is improved. In addition, in this case, arrangement of the cuff iron buck 25 below the collar iron buck 2 enables a small-sized device or a space saving to be attained.

Further, in the present invention, it may also be applicable that the collar iron buck 2 is fallen into a flat surface shape by a damper, for example, or formed to be recovered.

In addition, although the receiving plate 23 is formed to be moved forward or retracted in the foregoing example, it may also be applicable in the present invention that the receiving plate 23, for example, is turned from the rear upper part toward the front side and arranged at the upper surface position 2*a* and when the receiving plate 23 is pulled out, it may be slid and retracted.

What is claimed is:

1. A shirts press formed to comprise a collar iron buck on which a collar of a shirts is mounted while being expanded, and a press iron for depressing against the upper surface of the collar iron buck to press the collar, wherein the upper surface position of the collar iron buck corresponding to the central part of the collar in its longitudinal direction is notched in an inverse triangular shape as seen from its front elevational view;

the right and left positions corresponding to both ends of the collar in its longitudinal direction communicating with the upper surface position are formed into a horizontal surface;

when the upper surface of the collar iron buck is depressed by the press iron, the surface is formed into a flat surface in such a way that it may be fallen;

when the collar is mounted on the collar iron buck, there is provided a receiving plate for supporting the central part of the collar in its longitudinal direction;

the receiving plate is arranged above the upper surface position notched in an inverse triangular shape with the right and left positions corresponding to both ends of the collar and the height being set the same to each other;

when the press iron depresses against the collar, it is formed in such a way that it can be pulled out; and the iron surface of said press iron is formed into a flat surface.

2. The shirts press with a function for expanding the collar according to claim 1, wherein a pair of right and left mountain-shaped cuff iron bucks for use in setting cuffs of the shirts are arranged below the collar iron buck;

the iron parts for depressing against the upper surfaces of the cuff iron bucks are formed, while being notched in a mountain-shape in an upward direction, at the lower surface of the collar iron buck; and the collar iron buck is formed in such a way that it can depress against the cuff iron bucks.

3. The shirts press with a function for expanding the collar according to claim 1, wherein the upper surface position of the collar iron buck corresponding to the central part of the collar in its longitudinal direction is formed by a pair of right and left plates;

springs are arranged below a pivot shaft for pivoting the plates;

when the upper surface position of the collar iron buck is depressed by the press iron to become a flat surface state, it is formed such that it can descend while being kept in flat surface state during the maximum compression stroke of the springs.

4. The shirts press with a function for expanding the collar according to claim 3, wherein there is provided each of a pair of right and left springs at the front side and the rear side of the collar iron buck.

5. The shirts press with a function for expanding the collar according to claim 1, wherein a cylinder for advancing or retracting the receiving plate is arranged at a rear side of the collar iron buck in a horizontal state.

6. The shirts press with a function for expanding the collar according to claim 5, wherein the cylinder is a rod-less cylinder and a receiving plate is fixed to an operating part of advancing or retracting in the rod-less cylinder.

* * * * *